US012077938B2

(12) United States Patent
Borgman et al.

(10) Patent No.: US 12,077,938 B2
(45) Date of Patent: Sep. 3, 2024

(54) SECONDARY CONTROL SYSTEM AND METHOD FOR MOUNTING WITH SERVICE ORIENTATION

(71) Applicant: Caterpillar Inc., Peoria, IL (US)

(72) Inventors: Sarah J. Borgman, Dunlap, IL (US); Benjamin Thomas Nelson, Dunlap, IL (US); Michael William Bridenbaugh, Sewickley, PA (US)

(73) Assignee: Caterpillar Inc., Peoria, IL (US)

( * ) Notice: Subject to any disclaimer, the term of this patent is extended or adjusted under 35 U.S.C. 154(b) by 240 days.

(21) Appl. No.: 17/499,550

(22) Filed: Oct. 12, 2021

(65) Prior Publication Data

US 2023/0116011 A1 Apr. 13, 2023

(51) Int. Cl.
*E02F 9/08* (2006.01)
*E02F 9/16* (2006.01)
(Continued)

(52) U.S. Cl.
CPC ..... *E02F 9/0891* (2013.01); *E02F 9/16* (2013.01); *E02F 9/205* (2013.01); *E02F 9/264* (2013.01); *E02F 9/2004* (2013.01)

(58) Field of Classification Search
CPC . E02F 9/0891; E02F 9/16; E02F 9/205; E02F 9/264; E02F 9/2004; E02F 9/0858; E02F 9/267; E02F 9/163; G05B 2219/2637; G05B 2219/45012; G05B 2219/45046; G05B 2219/25326; G05B 2219/40009; G05B 2219/23458; B60J 7/08; B60J 7/11; B60J 7/1642; B60J 7/1628; B60J 7/19; B60J 7/194; B60J 7/196; B60J 7/1621; B60J 7/1657; B62D 25/10; B62D 25/12; B62D 33/073; B62D 33/0617; E05C 17/00; E05C 17/02; E05C 17/047; E05C 17/46; E05C 19/188; B66C 13/52; B66C 13/54; B60H 1/00378; E06B 1/526; E06B 3/5009; E06B 3/5054; E06B 3/52; B60K 35/00; B60K 2370/682; B60R 2011/008; B60R 2011/001; B60R 2011/004; B60R 2011/0052; B60R 2011/0078; B60R 2011/0028
See application file for complete search history.

(56) References Cited

U.S. PATENT DOCUMENTS 2,997,333 A * 8/1961 Kauffman ..... B66C 13/54 180/89.12
3,052,931 A * 9/1962 Ewing ..... E06B 3/50 49/176
(Continued)

*Primary Examiner* — Timothy Wilhelm

(57) ABSTRACT

A work machine includes a frame, a traction system, an engine, an implement system, an operator cab with a roof; a machine control system, and a secondary control system. The secondary control system is configured to interface with the machine control system and includes a secondary control device, a control module, a communication module, a base plate, and two rails. The base plate is configured to support the control module and the communication module, and protect the plurality of harness connections. The two rails are configured to support the base plate in an operation orientation and a service orientation and each include a plurality of channels configured to support the base plate in the service orientation.

20 Claims, 10 Drawing Sheets

(51) Int. Cl.
*E02F 9/20* (2006.01)
*E02F 9/26* (2006.01)

(56) References Cited

U.S. PATENT DOCUMENTS 3,080,981 A * 3/1963 Kuschel ..... B66C 13/54 212/290
3,277,511 A * 10/1966 Little ..... A47L 11/4083 15/353
3,524,398 A * 8/1970 Winfrey ..... F24F 8/10 454/157
3,657,992 A * 4/1972 Minnick, Jr. ..... B60H 1/00378 55/467
3,867,486 A * 2/1975 Nagele ..... F24F 6/04 261/106
3,888,165 A * 6/1975 Hattass ..... B60J 7/0435 454/94
3,913,701 A * 10/1975 Williams ..... B60K 37/00 296/70
4,021,073 A * 5/1977 Manning ..... B60J 7/1642 292/228
4,033,621 A * 7/1977 Rogers ..... B60J 7/1657 296/176
4,038,910 A * 8/1977 Kneusels ..... B60J 7/11 49/153
4,038,911 A * 8/1977 Hart ..... F24F 13/10 454/94
4,097,085 A * 6/1978 Nelson ..... B62D 61/10 280/847
4,119,340 A * 10/1978 Wolfe ..... B60J 7/1621 296/216.02
4,133,574 A * 1/1979 Martin ..... B60H 1/00378 392/407
4,223,943 A * 9/1980 VanHulle ..... E05C 9/04 292/DIG. 60
4,351,560 A * 9/1982 Kanou ..... B60J 7/11 296/218
4,412,404 A * 11/1983 Manning ..... B60J 7/1642 52/72
4,433,506 A * 2/1984 Manning ..... B60J 9/02 49/141
4,466,656 A * 8/1984 Igel ..... B60J 7/1642 296/216.02
4,468,064 A * 8/1984 McAdams, Sr. ..... B60J 7/194 296/224
4,503,749 A * 3/1985 Kuhn ..... B62D 33/0617 454/158
4,519,645 A * 5/1985 Kelly ..... B60J 7/1642 292/241
4,549,625 A * 10/1985 Tindall ..... B60K 35/00 296/70
4,563,036 A * 1/1986 Bauer ..... B60J 7/11 296/218
4,608,834 A * 9/1986 Rummel ..... B60H 1/00378 296/216.02
4,660,462 A * 4/1987 Thompson ..... F04B 17/04 55/498
4,723,812 A * 2/1988 Masuda ..... B60J 7/11 292/277
4,964,673 A * 10/1990 Lamparter ..... B60J 9/02 296/216.02
5,137,327 A * 8/1992 Edmonds ..... B60J 9/02 16/259
5,248,278 A * 9/1993 Fuerst ..... B60H 1/00457 296/222
5,342,238 A * 8/1994 Segerpalm ..... B60H 3/0608 454/158
5,540,478 A * 7/1996 Schuch ..... B62D 25/06 296/210
5,567,004 A * 10/1996 Pietzsch ..... B60R 11/0264 180/326
5,671,820 A * 9/1997 Kobayashi ..... E02F 9/0891 180/69.21
5,732,512 A * 3/1998 Ueno ..... E02D 29/14 404/26
5,851,444 A * 12/1998 Hansell, Jr. ..... F24F 6/043 261/106
5,921,619 A * 7/1999 Cederberg ..... B60H 1/00378 454/136
6,030,029 A * 2/2000 Tsuda ..... B62D 25/10 296/203.02
6,149,228 A * 11/2000 O'Neill ..... B62D 33/0621 296/190.08
6,186,584 B1 * 2/2001 Samuelson ..... B60J 7/08 296/213
6,283,220 B1 * 9/2001 Carter ..... B62D 1/24 901/1
6,309,012 B1 * 10/2001 Fryk ..... B62D 33/0617 296/210
6,322,136 B2 * 11/2001 Boyce ..... B60H 1/247 296/214
6,339,934 B1 * 1/2002 Yoon ..... B60H 1/00535 62/244
6,343,828 B1 * 2/2002 Young ..... B60J 7/1621 296/100.1
6,347,484 B1 * 2/2002 Swanger ..... B60J 7/1642 49/193
6,349,990 B1 * 2/2002 Park ..... B60J 7/1642 296/216.02
6,374,936 B1 * 4/2002 Smith ..... B62D 25/10 180/69.23
6,394,539 B1 * 5/2002 Park ..... B60J 7/1642 296/216.02
6,464,291 B2 * 10/2002 Hynds ..... B60J 7/08 296/213
6,514,135 B1 * 2/2003 Kelly ..... B60H 1/262 454/136
6,572,182 B2 * 6/2003 Lamparter ..... E05F 15/63 296/216.02
6,609,750 B1 * 8/2003 Cauduro ..... B60J 9/02 296/216.02
6,669,272 B2 * 12/2003 Ayabe ..... B60J 5/0487 296/190.08
6,688,682 B2 * 2/2004 Arthur ..... B60J 7/1642 296/216.02
6,780,097 B2 * 8/2004 Shuttleworth ..... B60H 1/00378 454/158
6,840,572 B2 * 1/2005 Sillanpää ..... B60J 7/1642 296/222
7,066,523 B2 * 6/2006 Verduci ..... B60J 7/1621 296/100.06
7,261,173 B2 * 8/2007 Kurtz, Jr. ..... E02F 9/0891 180/69.2
7,377,561 B2 * 5/2008 Shin ..... E05B 79/20 296/193.11
7,484,793 B2 * 2/2009 Baro ..... B60H 1/00378 296/190.09
7,530,542 B2 * 5/2009 Boyce ..... B60R 11/02 108/4
7,731,273 B2 * 6/2010 Hagele ..... E02F 9/163 296/190.08
7,806,214 B2 * 10/2010 Tsukui ..... B62D 25/12 180/89.17
7,845,711 B2 * 12/2010 Orrell ..... B60J 1/1807 296/146.16
7,967,094 B2 * 6/2011 Matsushita ..... E02F 9/0891 180/69.2
8,240,415 B2 * 8/2012 Okada ..... E02F 9/00 180/69.2
8,303,026 B2 * 11/2012 Yamashita ..... B62D 33/0617 296/146.16
8,333,355 B2 * 12/2012 Stifal ..... F16M 11/2092 248/920
8,347,554 B2 * 1/2013 Uto ..... E05C 17/025 49/394
8,376,719 B2 * 2/2013 Grady ..... F04D 29/4293 417/364
8,413,382 B2 * 4/2013 Uto ..... E05D 11/06 49/381

(56) References Cited

U.S. PATENT DOCUMENTS 8,480,141 B2 * 7/2013 Lee ..... E05C 17/28 248/351
8,535,127 B2 * 9/2013 Malott ..... F24F 13/10 52/302.1
8,556,329 B2 * 10/2013 Uto ..... B60J 5/045 49/502
8,622,266 B2 * 1/2014 McMillan ..... B60R 3/007 224/323
8,657,048 B2 * 2/2014 Uetake ..... B60K 11/08 280/847
8,695,825 B2 * 4/2014 Oksnevad ..... B65D 90/10 206/508
8,701,953 B2 * 4/2014 Bopp ..... B64D 45/00 224/547
8,870,516 B2 * 10/2014 Bonora ..... H01L 21/67766 49/504
8,905,435 B2 * 12/2014 Ripley ..... B62J 7/04 292/84
8,936,127 B2 * 1/2015 Kanamaru ..... E02F 9/0866 180/69.24
8,944,199 B2 * 2/2015 Fukunaga ..... B60H 1/00535 296/210
9,004,212 B2 * 4/2015 Noda ..... B62D 25/12 180/69.24
9,016,418 B2 * 4/2015 Ootsuka ..... E02F 9/0833 180/324
9,033,402 B2 * 5/2015 Salvini ..... B62D 29/001 296/210
9,120,603 B2 * 9/2015 Sekse ..... B65D 90/587
9,121,161 B2 * 9/2015 Manabe ..... E02F 9/18
9,181,679 B2 * 11/2015 Matsumoto ..... B62D 55/06
9,193,246 B2 * 11/2015 Wood ..... B60H 1/245
9,213,331 B2 * 12/2015 Johnson ..... E02F 9/205
9,222,297 B2 * 12/2015 Uehara ..... E06B 3/5054
9,284,159 B2 * 3/2016 Koskelainen ..... B66B 11/0226
9,394,668 B2 * 7/2016 Sakai ..... F01N 13/1805
9,441,344 B2 * 9/2016 Tanaka ..... E02F 9/16
9,453,326 B2 * 9/2016 Shimohira ..... B60K 13/04
9,464,402 B2 * 10/2016 Manabe ..... E02F 9/0858
9,518,373 B1 * 12/2016 Ueda ..... E02F 9/0891
9,551,499 B1 * 1/2017 Chwala ..... F24F 7/025
9,561,826 B2 * 2/2017 Kim ..... E05D 15/40
9,574,322 B2 * 2/2017 Ozaki ..... E02F 9/0875
9,592,723 B2 * 3/2017 Ohdoi ..... B60J 7/05
9,650,759 B2 * 5/2017 Dolan ..... E02F 9/2066
9,670,646 B2 * 6/2017 Ohmura ..... E02F 9/0866
9,670,647 B2 * 6/2017 Sanada ..... E02F 9/0891
9,815,502 B1 * 11/2017 Uratani ..... B60J 5/0487
9,834,966 B2 * 12/2017 Alfredsson ..... E05D 15/505
9,863,121 B2 * 1/2018 Huissoon ..... E02F 9/0883
9,902,233 B2 * 2/2018 Thompson ..... B60H 1/00378
9,915,055 B2 * 3/2018 Vanek ..... E02F 9/0891
9,931,920 B1 * 4/2018 Stojkovic ..... B60J 7/11
9,988,830 B2 * 6/2018 Raz ..... E05C 1/12
10,030,362 B2 * 7/2018 Yamashita ..... B62D 33/06
10,087,602 B2 * 10/2018 Matsumura ..... B62D 25/12
10,150,366 B2 * 12/2018 Yamashita ..... B60K 15/07
10,316,557 B2 * 6/2019 Hartz ..... E05F 7/04
10,336,160 B2 * 7/2019 Vergamini ..... B60H 1/3202
10,340,838 B2 * 7/2019 Schuit ..... F24S 25/636
10,385,538 B2 * 8/2019 Wagner ..... E02F 9/0833
10,385,546 B2 * 8/2019 Noda ..... G05D 1/0038
10,422,264 B2 * 9/2019 Itou ..... B60K 13/04
10,450,721 B2 * 10/2019 Inukai ..... F02D 41/00
10,550,546 B2 * 2/2020 Hirano ..... B62D 33/0617
10,550,568 B2 * 2/2020 Ndobo-Epoy ..... E04C 3/005
10,640,949 B2 * 5/2020 Hirasawa ..... E02F 9/0883
10,735,042 B2 * 8/2020 Barimani ..... B60K 37/04
10,821,910 B2 * 11/2020 Abe ..... E02F 9/16
10,931,225 B2 * 2/2021 Yang ..... F24S 25/30
10,961,689 B2 * 3/2021 Iwamoto ..... E02F 9/18
10,982,394 B2 * 4/2021 Sperling ..... E01B 29/10
10,992,250 B2 * 4/2021 Ayers ..... H02S 40/22
11,015,299 B2 * 5/2021 Sperling ..... E01B 29/32
11,192,432 B2 * 12/2021 Brown ..... B60J 7/146
11,251,743 B2 * 2/2022 Schuit ..... H02S 20/30
11,264,693 B2 * 3/2022 Hart ..... H01Q 1/3233
11,358,450 B2 * 6/2022 Eger ..... B60J 7/0435
11,433,748 B2 * 9/2022 Motomura ..... B60J 7/043
11,512,529 B2 * 11/2022 Fisher, II ..... E06B 9/50
11,541,707 B2 * 1/2023 De Smidt ..... B62D 21/02
11,548,658 B2 * 1/2023 Robertson, Jr. ..... B60J 7/043
11,623,584 B2 * 4/2023 Seki ..... E02F 9/121 180/69.21
2007/0063549 A1 * 3/2007 Sap ..... B62D 33/0617 296/216.02
2007/0210079 A1 * 9/2007 Oksnevad ..... B65D 88/126 220/1.5
2007/0210619 A1 * 9/2007 Jo ..... B60J 5/0487 296/190.11
2011/0233963 A1 * 9/2011 Yamashita ..... B62D 33/0617 296/190.11
2013/0074410 A1 * 3/2013 Berkeland ..... E02F 9/0866 49/142
2016/0122975 A1 * 5/2016 Vanek ..... E02F 9/0891 16/221
2019/0317521 A1 10/2019 Nishi et al.
2019/0323206 A1 * 10/2019 Colwell ..... E02F 9/18
2020/0164730 A1 * 5/2020 Willard ..... B60J 7/19
2021/0114440 A1 * 4/2021 Erhardt ..... E05D 7/00
2021/0162931 A1 * 6/2021 Bruegl ..... F16M 11/2028
2021/0276645 A1 * 9/2021 O'Donnell ..... E02F 9/264
2021/0285599 A1 * 9/2021 Sisto ..... A47B 96/067
2021/0394785 A1 * 12/2021 O'Donnell ..... B60W 10/18
2022/0056645 A1 * 2/2022 Wyatt ..... E01B 9/681
2022/0105783 A1 * 4/2022 Torii ..... B62D 25/12
2022/0205218 A1 * 6/2022 Kim ..... B62D 37/04
2023/0013108 A1 * 1/2023 Hamel-Gagnon ..... B62D 7/06
2023/0136637 A1 * 5/2023 Gozzi ..... B60J 7/165 296/216.03

* cited by examiner

SECONDARY CONTROL SYSTEM AND METHOD FOR MOUNTING WITH SERVICE ORIENTATION

TECHNICAL FIELD

The present disclosure relates generally to tractor machines, and more specifically to machines with a secondary control system.

BACKGROUND

Work machines are used for innumerable purposes across many industries. These machines includes construction machines such as motor graders, excavators, and bulldozers; farm equipment such as tractors and combines; mining equipment; cement trucks; dump trucks; garbage trucks; and the like, During the performance of tasks, the machines may operate in situations that are unsuitable or undesirable for a human operator such as hazardous conditions, extreme environmental conditions, uncomfortable for an operator, or at work locations remote from civilization. Because of these factors, the completion of some tasks by an onboard operator may be dangerous, expensive, and otherwise undesirable.

One solution is to control and operate the machines with a secondary control system. In some situations, a remote control system may be added to a machine as an after-market addition. U.S. Pat. No. 9,213,331 to Johnson describes such a remote control system.

However, many of these systems must be removed completely from the machine for maintenance, diagnostics, and other servicing. Therefore, there is a need for a method for mounting a secondary control system that allows for in-situ maintenance.

SUMMARY OF THE DISCLOSURE

According to one aspect of the present disclosure, a work machine is disclosed. The work machine includes a frame, a traction system, an engine, an implement system, an operator cab with a roof a machine control system, and a secondary control system. The secondary control system is configured to interface with the machine control system and includes a secondary control device, a control module, a communication module, a base plate, and two rails. The base plate configured to support the control module and the communication module, and protect the plurality of harness connections. The two rails are configured to support the base plate in an operation orientation and a service orientation and each include a plurality of channels configured to support the base plate in the service orientation.

According to another aspect of the present disclosure, a secondary control system is disclosed. The secondary control system includes a secondary control device configured to accept input from a remote operator, a plurality of electrical components including a secondary control module and a communications module, a base plate configured to support the plurality of components, a first rail, and a second rail. Each of the rails is configured to support the secondary control system in an operation orientation and a service orientation and includes a first flange configured to be attached to a surface, a web, a second flange, and a plurality of channels extending from the second flange into the web.

According to yet another aspect of the present disclosure, a method of moving a secondary control system into a service orientation is disclosed. The method includes providing a secondary control system with a base plate mounted to two rails in an operation orientation, removing a plurality of bolts attaching the base plate to the rails, lifting the base plate and lowering the base plate into a channel on each of the two rails, the base plate being supported by the channels in a service orientation These and other aspects of the present disclosure will be more readily understood after reading the following detailed description in conjunction with the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
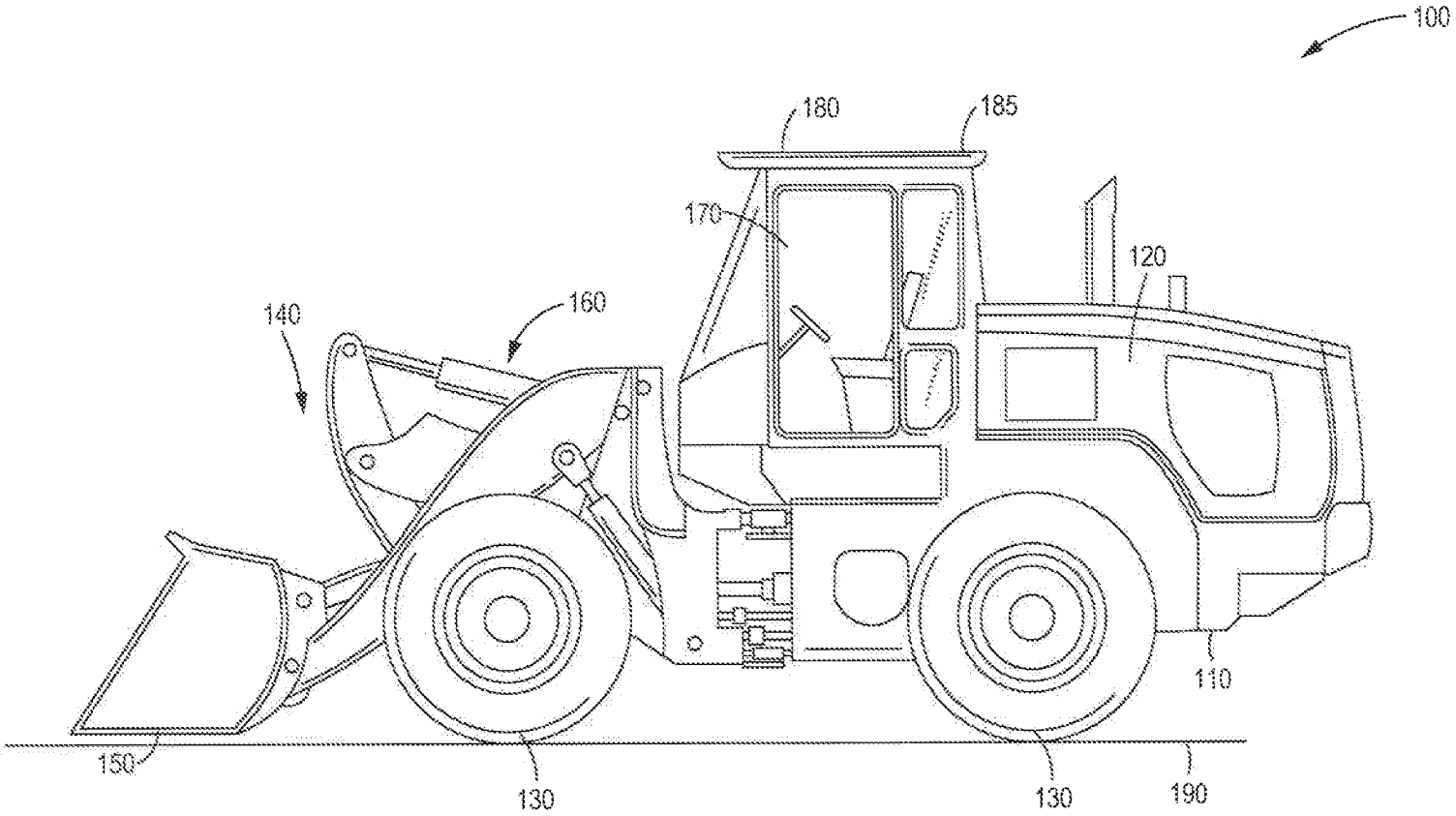
FIG. 1 is a side view of a work machine, according to one aspect of the present disclosure.

Referring now to the drawings, and with specific reference to FIG. 1, a work machine in accordance with the present disclosure is generally referred to by reference numeral 100. The work machine 100 may be any one of a number of different earth moving, construction, agricultural, or industrial machines, such as a motor grader, mining truck, bulldozer, excavator, tractor, or the like. As such, the depicted wheel loader is only one example of a possible work machine according to the present disclosure.

The work machine includes a frame 110, a propulsion system 120 mounted to the frame 110, and a traction system 130 supporting the frame 110 and driven by the propulsion system 120. The propulsion system 120 may include a power source such as a combustion engine or electric motor and a transmission. The traction system 130 may include wheels (as shown), tracks, treads, or the like which enable the work machine 100 to engage the ground and move.

The machine 100 may additionally have an implement system 140 supported by the frame 110. The implement system 140 may include various implements 150 attached to the machine 100 to perform a variety of jobs. The illustrated machine 100 is equipped with a bucket 150; however, many other implements may be used on other machines to perform different types of work. Some machines 100 may include more than one implement, while others such as trucks may have no implement. A hydraulic system 160 may be utilized to drive the movement of the implement system 140.

The machine 100 also includes an operator cab 170 supported by the frame 110. The cab includes a roof 180, A top surface of the roof 185 is generally flat and parallel to the plane of the ground surface 190 below the machine 100. The operator cab 170 is configured to allow an operator to control the systems 120, 130, 140, 160 of the machine through an operator interface 210 (see FIG. 2), The operator interface 210 may include a plurality of operator input devices such as joysticks, buttons, touchscreens, steering wheel, switches, and the like, and may also include a plurality of display devices such as screens, lights, dials or other indicators of the machine's status.

In addition, the machine 100 is equipped with a plurality of sensors 220 that gather data from various components and systems and generate signals that are indicative of the performance and operating conditions of the machine 100. Sensors 220 may be associated with, for example, the propulsion system 120, the traction system 130, the operator cab 170 and interface 210, the implement system 140 and hydraulics 160, and/or other systems and components of the machine 100.

Figure 2:
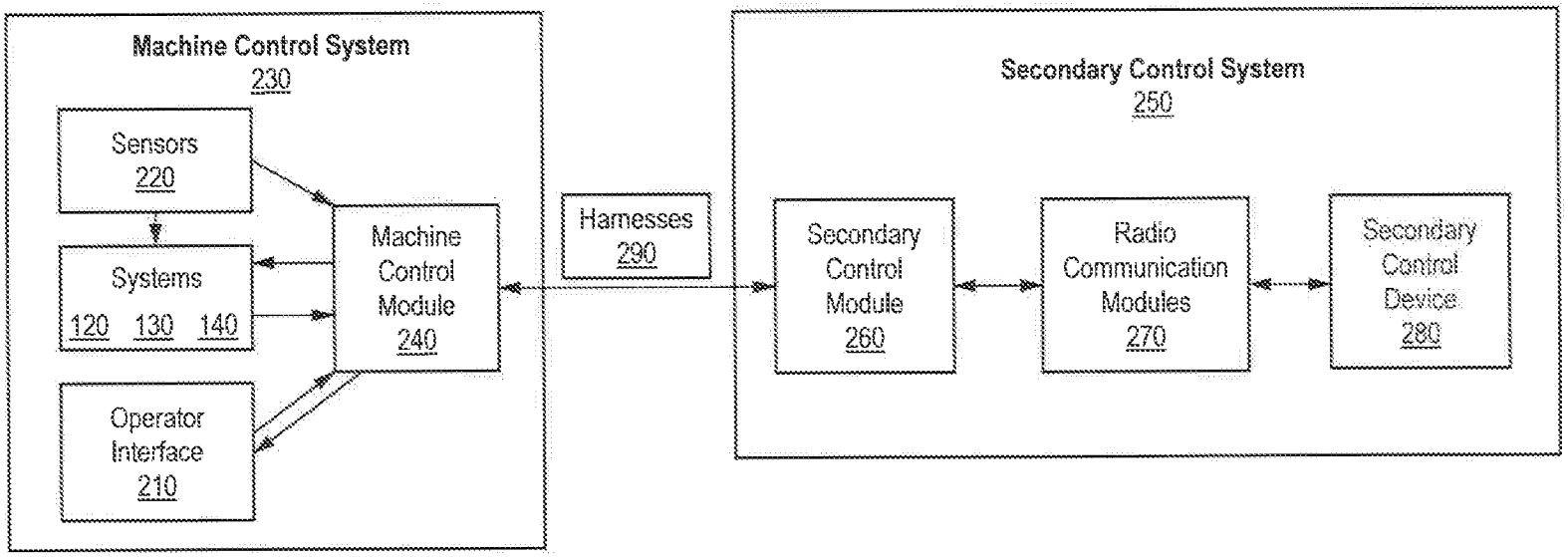
FIG. 2 is a block diagram of a control system, according to one aspect of the present disclosure.

A machine control system 230 is provided to control the operation of the machine 100. As shown in FIG. 2, the machine control system 230 includes a machine control module 240 which interfaces between the plurality of sensors 220, the operator interface 210, and the various systems 120, 130, 140, 160 of the machine 100. The machine control module 240 may be configured to provide an operator with information from the sensors and control the engine 120, traction system 130, implement system 140 and other systems and components as directed by an operator through the operator interface 210. The machine control module 240 may be a single control module or include a plurality of control modules interfacing with parts of the machine.

The machine 100 may also be equipped with a secondary control system 250. The secondary control system 250 is configured to interface with the machine control system 230 and allow control of the machine 100. For example, the secondary control system 250 may allow control of the machine from the machine 100, may allow for video recording ay allow for collision avoidance, may allow for machine automation, and the like. The secondary control system 250 includes a plurality of electrical components which may include a secondary control module 260, a communication module 270, a secondary control device 280, and a plurality of harnesses 290. The secondary control module 260 interfaces between the machine control module 240 and the secondary control device 280 to allow the operator to control the machine 100. The communication module 270 is configured to provide wireless communication between the secondary control module 260 and the secondary control device 280. The communication module 270 may include a plurality of transmitters and receivers. The wireless communication may be through radio, Bluetooth, an wireless network, or other similar means. The remote control device 280 includes an operator interface which may include a plurality of displays and input devices. The secondary control device 280 also includes transmitters and receivers to communication with the communication module 270. The control module 260 and the communication module 270 are mounted on the machine, while the secondary control device 280 may be located at a distance from the machine, limited by the range of the communication method used. The plurality of harnesses 290 provide electrical connections between the machine 100 and the control 260 and communication modules 270 to provide power to the components and interface between the secondary control system 250 and the machine control system 230.

In order to allow for an efficient connection between the secondary control system 250 and the machine 100, the secondary control system 250 may be located adjacent to the machine control module 240. In order to be protected from the environment and wear caused by the operation of the machine 100, the roof 180 of the cab 170 provides a suitable location, hut other locations are possible.

In some alternative embodiments, the secondary control system 250 may be mounted to a different surface of the machine other than the roof 180 of the operator cab 170. This machine surface should be substantially flat and parallel to a ground surface and located to allow the secondary control system 250 to interface with the machine control system 230.

Figure 3:
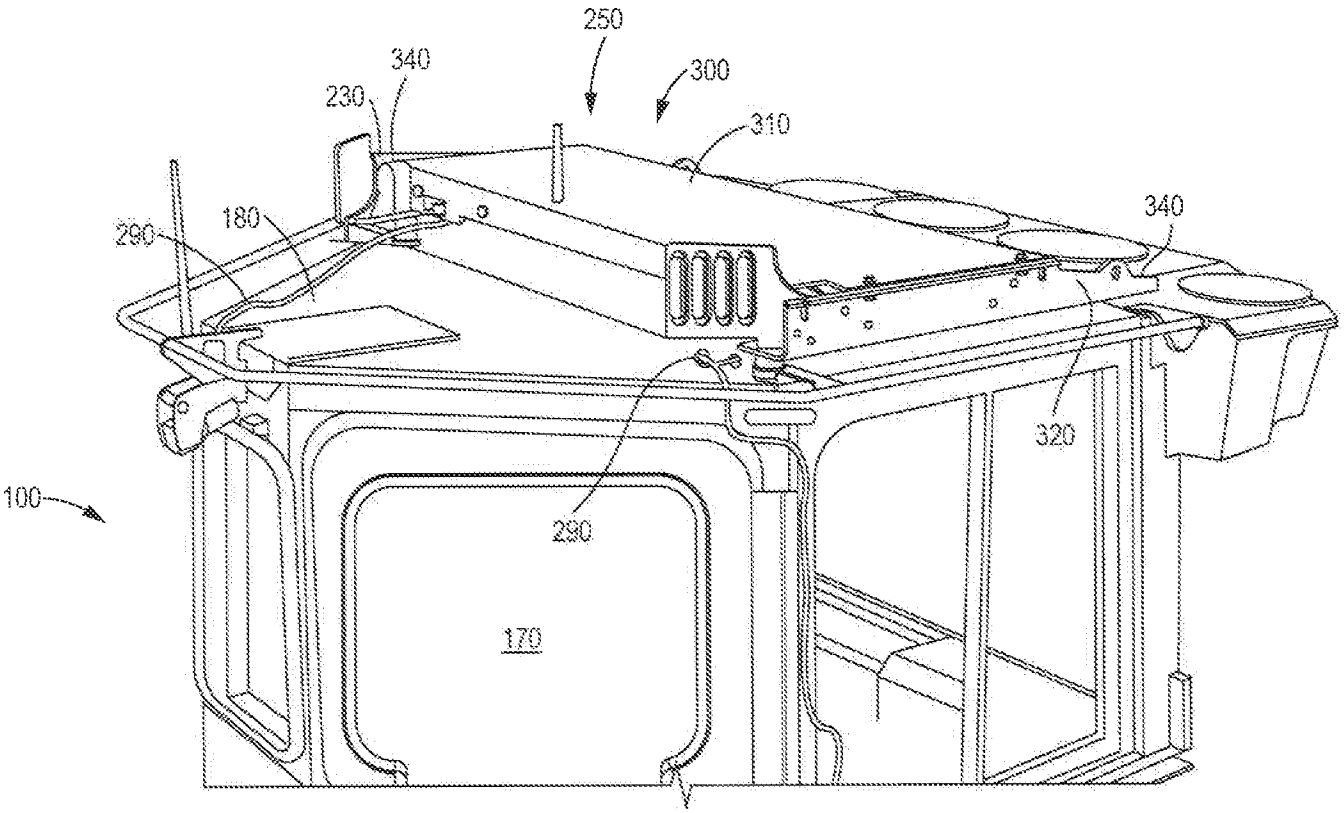
FIG. 3 is a perspective view of the cab roof of the work machine of FIG. 1, according to one aspect of the present disclosure.
Figure 4:
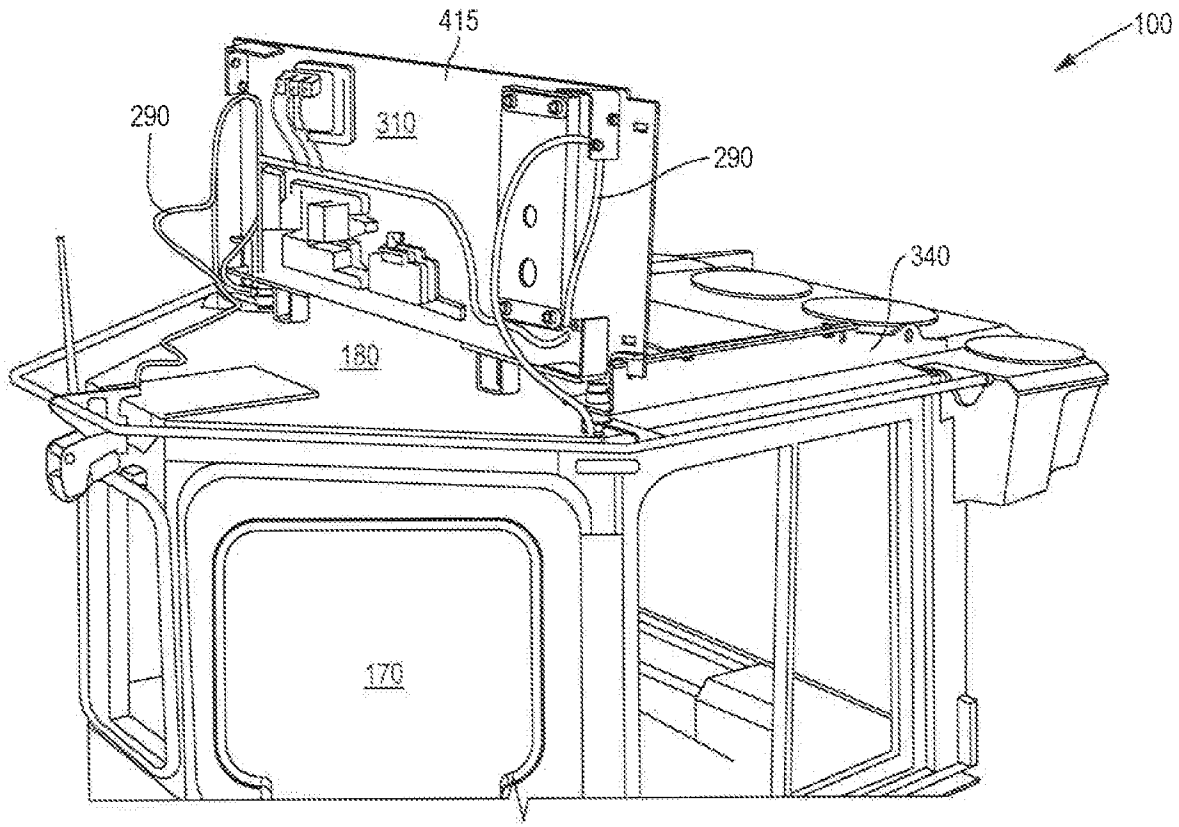
FIG. 4 is a perspective view of the cab roof of the work machine of FIG. 1, according to one aspect of the present disclosure.

In order to mount the secondary control system 250 to the roof 170 of the operator cab 170, the secondary control system 250 further includes a mounting system 300, as shown in FIGS. 3 and 4. The mounting system 300 includes a base plate 310, a first rail 320, and a second rail 330. The first rail 320 and the second rail 330 are mirror images of each other and may be described collectively as the rails 340. The rails 340 are configured to support the base plate 310 in an operation orientation (shown in FIG. 3) and a service orientation (shown in FIG. 4).

Figure 5:
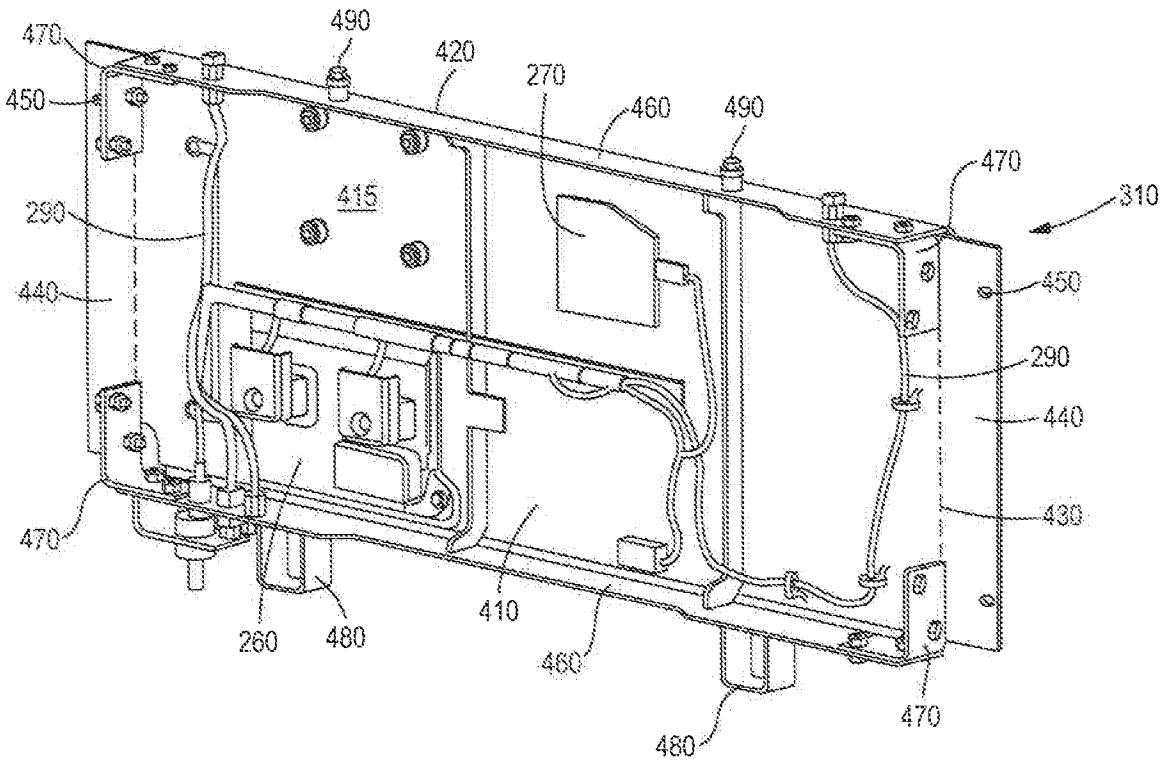
FIG. 5 is a perspective view of a base plate, according to one aspect of the present disclosure.

As shown in FIG. 5, the base plate 310 is made up of a large panel 410 with a lower face 415 on which components including the secondary control module 260 and the communication module 270 may be mounted. The panel 410 may be rectangular with two long sides 420, and two short sides 430. On each of the short sides 430, the panel includes a mounting surface 440 extending outward parallel to the plane of the panel 410. The mounting surfaces 440 may include a plurality of mounting holes 450. On each of the long sides 420, a lip 460 extends along the length of the panel 410 perpendicularly to the lower face 415. The lip 460 provides additional protection to the secondary control module 260 and the communication module 270 in the operation orientation. On each end of each of each lip 460, a corner bracket 470 is attached. The corner brackets 470 are attached to an inner side of the lip 460 and extend around 90 degrees to the short sides 430. Two kickstands 480 may extend from an outer side of one or both lips 460. One or both of the lips 460 may also include a mechanism 490 for attaching a crane.

In one embodiment, the long sides 420 of the panel 410 may be between 1290 mm and 1500 mm, and the short sides 430 of the panel 410 may be between 50 mm and 150 mm, although of course, other dimensions may be used as dictated by the size of the surface on which the remote control system is to be mounted.

Figure 6:
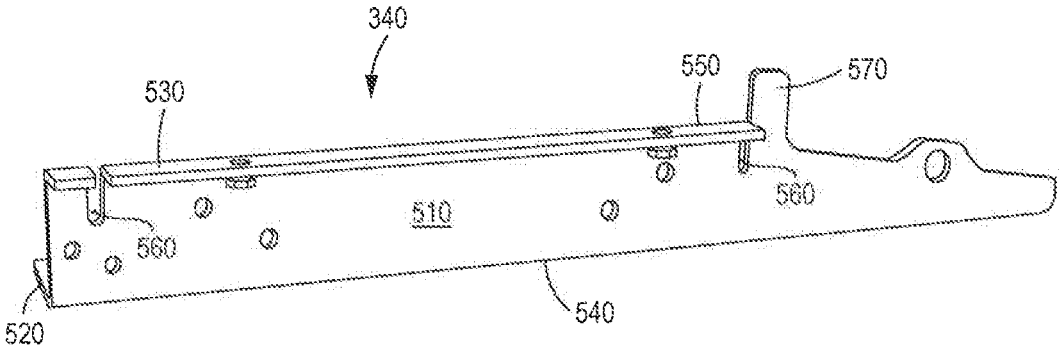
FIG. 6 is a perspective view of a rail, according to one aspect of the present disclosure.
Figure 7:
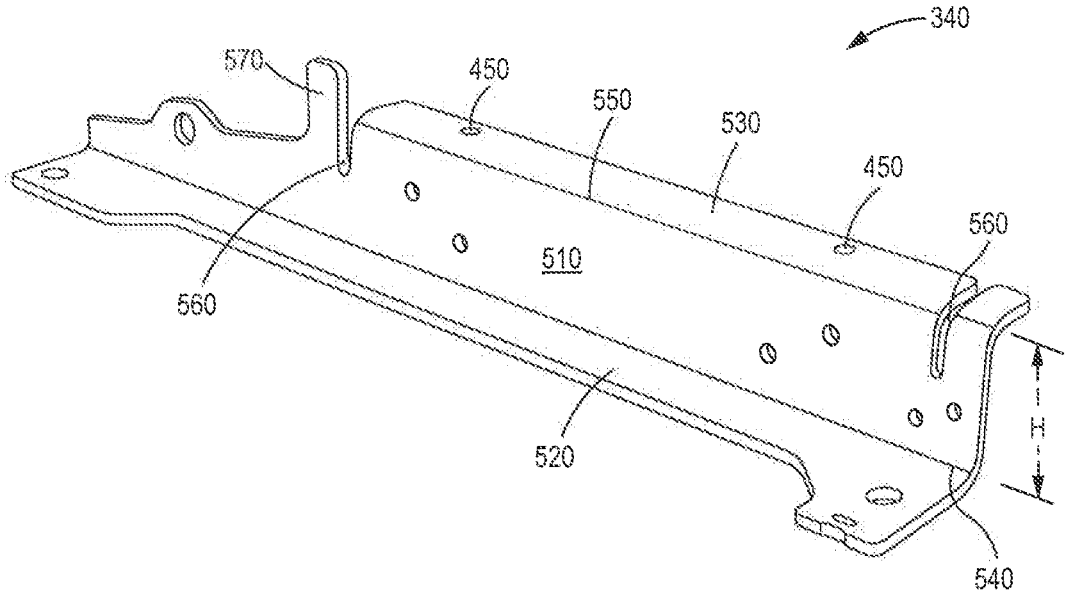
FIG. 7 is a perspective view of an opposite side of the rail of FIG. 6, according to one aspect of the present disclosure.

As shown in FIGS. 6 and 7, each of the rails 340 is an elongated beam shape with a web 510, a first flange 520, and a second flange 530, The first flange 520 is configured to be attached to the roof 180. The first flange 520 may be attached to the roof 180 by any suitable method, including bolts (as shown), screws, adhesive, and the like. The first flange 520 may include bolt holes as needed to secure the rail to the roof. The first flange 520 is connected to a first side 540 of the web 510. The web 510 extends perpendicularly from the first flange 520, away from the roof 180 when the rail 340 is mounted. The first flange 520 may extend from the web 510 in only one direction as depicted, toward the longitudinal axis of the machine 100 when mounted. Alternatively, the first flange 520 may extend from the web on both sides creating a wider area of contact with the roof.

Figure 8:
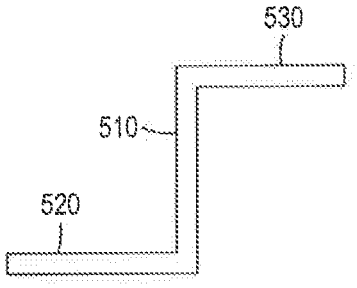
FIG. 8 is a cross-section of the rail of FIG. 6 and FIG. 7, according to one aspect of the present disclosure.

The second flange 530 extends perpendicularly from a second side 550 of the web 510. The second flange 530 is configured to extend away from the longitudinal axis of the machine 100 when mounted. The second flange 520 of each rail 340 is configured to connect to the mounting surface 440 of the base plate 310 in order to support the base plate 310 with its mounted components in the operation orientation. Together, the first flange 520, web 510, and second flange 530 may form a Z-shape in cross-section, as shown in FIG. 8.

Each of the rails 340 also includes a plurality of channels 560. Each channel 560 extends through the second flange 530 into the web 510, perpendicular to the rail 340. A channel 560 on the first rail 320 has a corresponding channel on the second rail 330. The rails 340 have at least one channel 560 each and may have a second channel 560. The channels may be at each end of the rail. Multiple channels 560 provides options for the location of the baseplate 310 on the roof 180 when in the service orientation. Some locations may be preferred for the particular machine 100 or by a particular service provider.

The rails 340 may also include an upright tab 570 extending from the web 510 to aid in guiding the base plate 310 into place. In some embodiments, as shown, the upright 570 may be located adjacent to a channel 560.

The height of the web (H) is greater than the lip 460 of the base plate 310 plus any components that may be mounted on the lower face 415. In one embodiment, the height H may be 80 mm, but of course other dimensions may be used as needed to accommodate the required components.

The channels 560 are configured to allow the mounting surface 440 to slide within. Therefore, the width of each channel 560 must be wider than the thickness of the mounting surface 440. In some embodiments, the mounting surface 440 may have a thickness of 6 mm and the channels 560 may have a width of 9 mm, but other dimensions are possible.

The rails 340 are mounted on each side of the roof 180 (or other machine surface) and positioned to be parallel to one another. The rails 340 may also be parallel to a longitudinal axis of the machine 100. The distance between the rails 340 when mounted is configured to allow the long sides 420 of the base plate 310 to fit between the web 510 of the first and second rails 340.

Figure 9:
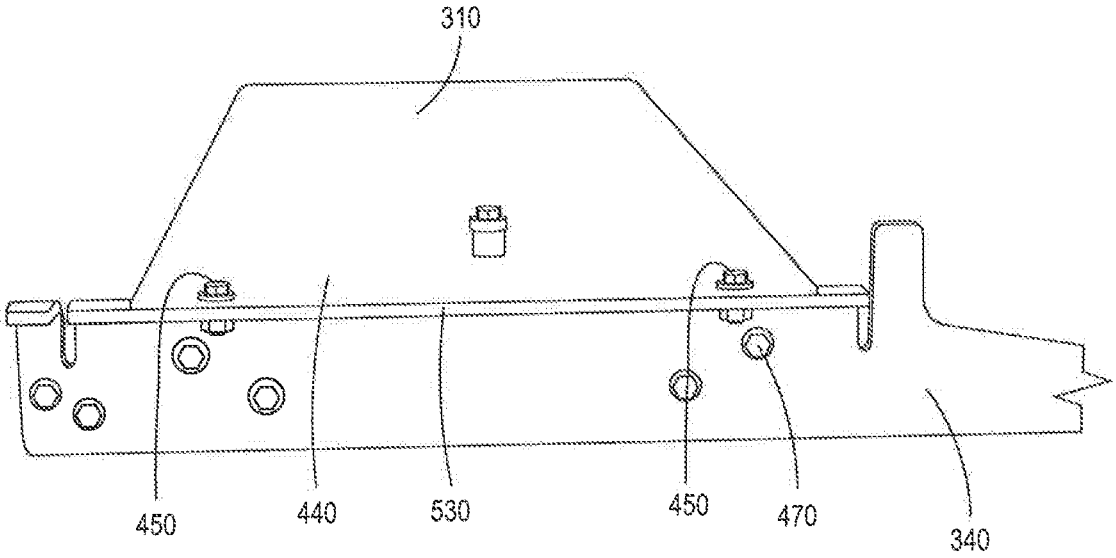
FIG. 9 is a perspective view of the rail and baseplate of FIGS. 5 and 6, according to one aspect of the present disclosure.

When in the operation orientation, the plane of the base plate 310 is parallel to the plane of the roof 180, as shown in FIGS. 3 and 9. The mounting surfaces 440 of the base plate 310 are resting on and removably attached to the second flanges 530 and the corner brackets 470 are removably attached to the web 510 of each rail 310. The control module 260 and the communication module 270 are protected between the base plate 310 and the roof 180.

Figure 10:
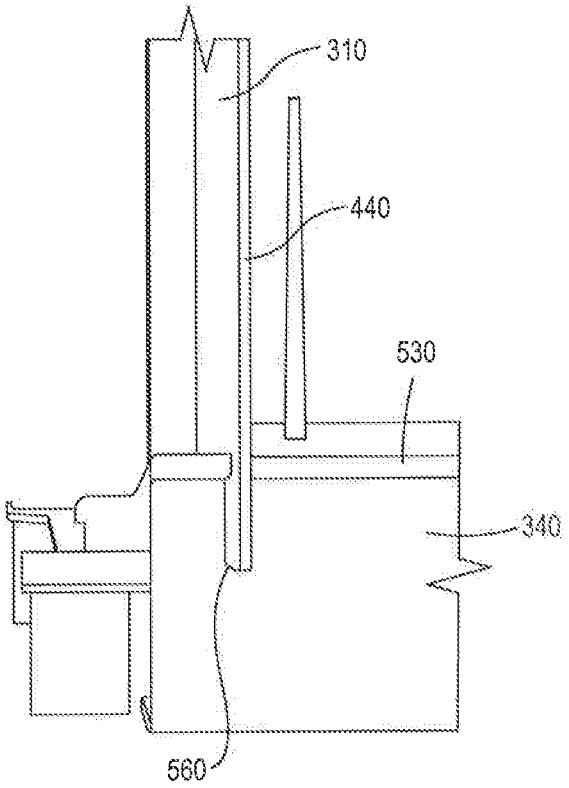
FIG. 10 is a perspective view of the rail and baseplate of FIGS. 5 and 6, according to one aspect of the present disclosure.

In the service orientation, the base plate 310 is perpendicular to the roof 180, as shown in FIG. 4. The mounting surface 440 is inserted into the channels 260 such that the base plate 310 stands upright (see FIG. 10). The base plate 310 may also be supported by the kickstands 480. The plurality of harnesses 290 remain connected to the machine 100 and the remote control system 250 so that maintenance can occur while the system is powered and connected.

Industrial Applicability

The present disclosure finds application for any machine with a secondary control system mounted on a roof or other machine surface. More generally, the mounting system disclosed above may be advantageous for numerous machines in which a secondary control system such was but not limited to remote control, video recording, collision avoidance and machine automation must be mounted to the outside of a machine and accessible for maintenance.

Figure 11:
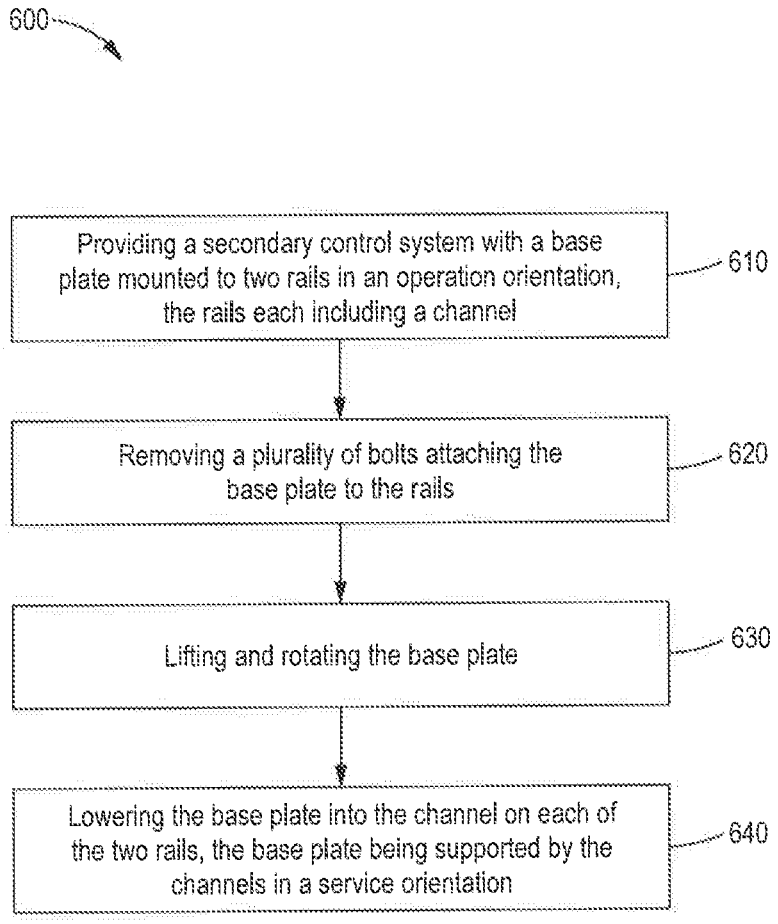
FIG. 11 is a perspective view of the baseplate of FIG. 5 being lifted by a crane.
Figure 12:
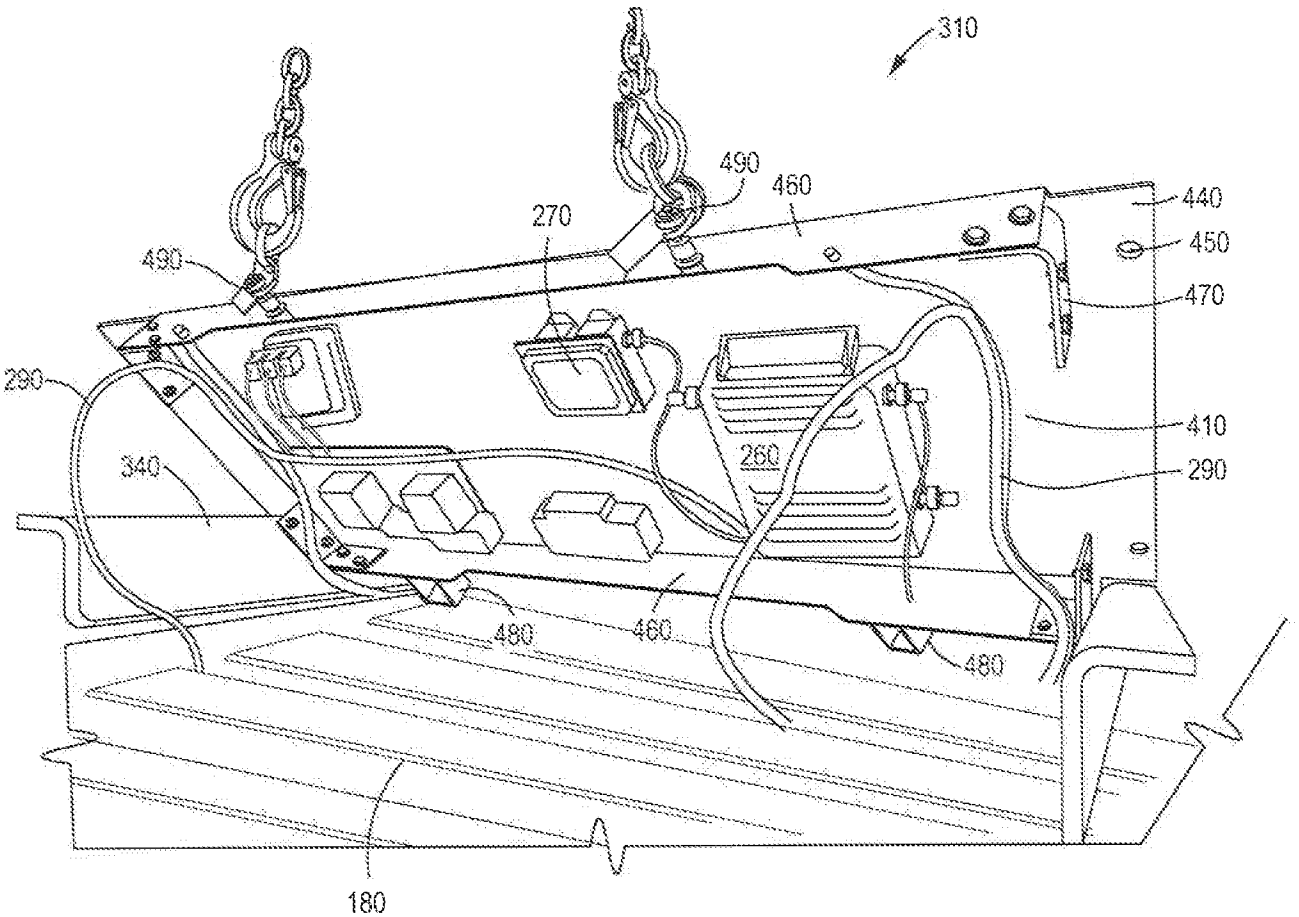
FIG. 12 is a method of moving the baseplate of Fla 5 between an operation orientation and a service orientation.

A method 600 for moving a mounted secondary control system into a service orientation is shown in FIG. 11, beginning in block 610. First, a secondary control system 250 is provided in which a base plate 310 is mounted to two rails 340 in an operation orientation (block 610), As previously described, in the operation orientation, the mounting surface 440 on each short side of the base plate 310 is attached to the second flange 530 of a rail 340 by bolts through a plurality of mounting holes 450 and the corner brackets 470 are attached to the web 510 of each rail by additional bolts. In some embodiments, there may be a total of 12 bolts, but of course other totals are possible.

In order to begin moving to the service position, all of these bolts are removed, as shown in block 620. Next, the base plate 310 is lifted and rotated (block 630). This may be done manually by an operator, or by attaching a crane to the base plate 310. The crane may be connected to the lip 460 on either long edge 420 of the base plate 310, as preferable for the particular servicing required or the arrangement of the roof 180. As the base plate 310 is lifted, it rotates into a position perpendicular to the roof 180. Finally, the base plate 310 is lowered into the channels 560 on each rail 340, as shown in block 640. Each mounting surface 440 fits within a channel so that the base plate 310 is supported in an upright position between the two rails 340. Kickstands 480 on the base plate 310 may provide additional support.

The method 600 may be reversed to return the base plate 310 to the operation orientation. During the process of moving between orientations, the secondary control system 250 does not need to be disconnected from the machine control system 230.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A work machine, comprising:

a frame a traction system supporting the frame;

an engine supported by the frame;

an implement system supported by the frame;

an operator cab supported by the frame, the cab having a roof;

a machine control system configured to control the traction system and implement system based on operator input; and a secondary control system configured to interface with the machine control system, the secondary control system having:

a secondary control device, a control module, a communication module, a plurality of harness connections, a base plate configured to support the control module and the communication module, and protect the plurality of harness connections, and two rails configured to support the base plate in an operation orientation and a service orientation, the rails each including a plurality of channels configured to support the base plate in the service orientation.

2. The work machine of claim 1, wherein the base plate is perpendicular to the roof in the service orientation.

3. The work machine of claim 1, wherein the base plate is parallel to the roof in the operation orientation.

4. The work machine of claim 1, wherein the base plate is a rectangular panel having:

a lower face, the lower face configured to permit mounting the secondary control module and the communication module, two long sides, the long sides having a lip extending perpendicularly from the lower face, two short sides, the short sides each having a mounting surface, each mounting surface configured to be removably attached to a rail.

5. The work machine of claim 4, the base plate further having a plurality of corner brackets attached to the lip, configured to be removably attached to the rail.

6. The work machine of claim 1, wherein the rails each have a first flange, a web, and a second flange, the first flange configured to be attached to the roof of the machine, the second flange configured to be removably attached to the base plate.

7. The work machine of claim 6, wherein the plurality of channels extend through the second flange into the web and are configured to support a mounting surface of the base plate such that the base plate is supported between the two rails perpendicularly to the roof.

8. A secondary control system, comprising:

a secondary control device configured to accept input, a plurality of electrical components including a secondary control module and a communications module;

a base plate configured to support the plurality of components;

a first rail; and a second rail, each of the rails configured to support the secondary control system in an operation orientation and a service orientation and having a first flange configured to be attached to a surface, a web, a second flange, and a plurality of channels extending from the second flange into the web.

9. The secondary control system of claim 8, wherein the base plate is perpendicular to the rails in the service orientation.

10. The secondary control system of claim 8, wherein the base plate is a rectangular panel having:

a lower face, the lower face configured to permit mounting the plurality of components, two long sides, the long sides having a lip extending perpendicularly from the lower face, two short sides, the short sides each having a mounting surface.

11. The secondary control system of claim 10, wherein each mounting surface is configured to be removably attached to the second flange of one of the two rails.

12. The secondary control system of claim 8, wherein the plurality of channels extend through the second flange into the web and are configured to support a mounting surface of the base plate such that the base plate is supported between the two rails perpendicularly to the roof.

13. A method of moving a secondary control system into a service orientation, comprising:

providing a secondary control system with a base plate mounted to two rails in an operation orientation, the rails each including a channel, a first flange, a web, and a second flange, the first flange configured to be attached to a surface, the second flange configured to be removably attached to the base plate;

removing a plurality of bolts attaching the base plate to the rails;

lifting and rotating the base plate; and lowering the base plate into the channel on each of the two rails, the base plate being supported by the channels in a service orientation, wherein the base plate is perpendicular to the rails in the service orientation.

14. The method of claim 13, wherein the base plate is a rectangular panel having:

a lower face, the lower face configured to permit mounting a plurality of components;

two long sides, the long sides having a lip extending perpendicularly from the lower face, two short sides, the short sides having a mounting surface, the mounting surface configured to be removably attached to a rail.

15. The method of claim 14, the base plate further having a plurality of corner brackets attached to the lip, configured to be removably attached to the rail.

16. The method of claim 13, wherein the plurality of channels extend through the second flange into the web and are configured to support a mounting surface of the base plate such that the base plate is supported between the two rails perpendicularly to the surface.

17. The method of claim 13, the base plate further having a plurality of kickstands attached to the lip, the kickstands configured to assist in supporting the base plate in the service orientation.

18. The method of claim 13, wherein the base plate is lifted with a crane.

19. A method of moving a secondary control system into a service orientation, comprising:

providing a secondary control system with a base plate mounted to two rails in an operation orientation, the rails each including a channel;

removing a plurality of bolts attaching the base plate to the rails;

lifting and rotating the base plate, wherein the base plate is lifted with a crane; and lowering the base plate into the channel on each of the two rails, the base plate being supported by the channels in a service orientation, wherein the base plate is perpendicular to the rails in the service orientation.

20. The method of claim 19, wherein the rails each include a first flange, a web, and a second flange, the first flange configured to be attached to a surface, the second flange configured to be removably attached to the base plate.

* * * * *